US009698472B2

(12) United States Patent
Miškovský et al.

(10) Patent No.: US 9,698,472 B2
(45) Date of Patent: Jul. 4, 2017

(54) ANTENNA DEVICE AND WEARABLE DEVICE COMPRISING SUCH ANTENNA DEVICE

(71) Applicant: Sunway Communication (Beijing) Co., Ltd., Beijing (CN)

(72) Inventors: Pavel Miškovský, Enskede (SE); Axel von Arbin, Täby (SE)

( * ) Notice: Subject to any disclaimer, the term of this patent is extended or adjusted under 35 U.S.C. 154(b) by 0 days.

(21) Appl. No.: 14/788,899

(22) Filed: Jul. 1, 2015

(65) Prior Publication Data

US 2016/0006111 A1 Jan. 7, 2016

(30) Foreign Application Priority Data

Jul. 4, 2014 (CN) ..... 2014 1 0318668
Jul. 4, 2014 (CN) ..... 2014 2 0370875 U

(51) Int. Cl.

| | |
|---|---|
| ***H01Q 1/12*** | (2006.01) |
| ***H01Q 1/27*** | (2006.01) |
| ***H01Q 9/04*** | (2006.01) |
| ***H01Q 9/40*** | (2006.01) |
| ***H01Q 9/42*** | (2006.01) |
| ***H01Q 5/40*** | (2015.01) |
| ***H01Q 1/36*** | (2006.01) |
| ***H01Q 1/48*** | (2006.01) |

(52) U.S. Cl.

CPC ..... *H01Q 1/273* (2013.01); *H01Q 1/36* (2013.01); *H01Q 1/48* (2013.01); *H01Q 5/40* (2015.01); *H01Q 9/0442* (2013.01); *H01Q 9/0471* (2013.01); *H01Q 9/40* (2013.01); *H01Q 9/42* (2013.01)

(58) Field of Classification Search

CPC ..... H01Q 9/0442; H01Q 9/42; H01Q 5/40; H01Q 9/40; H01Q 9/0471; H01Q 1/273; H01Q 1/36; H01Q 1/48

USPC ..... 343/718

See application file for complete search history.

(56) References Cited

U.S. PATENT DOCUMENTS

| | | | | |
|---|---|---|---|---|
| 6,366,250 | B1 * | 4/2002 | McConnell | H04B 1/385 343/718 |
| 7,038,634 | B2 * | 5/2006 | Bisig | H01Q 7/00 343/718 |
| 7,116,940 | B2 * | 10/2006 | Dvorak | H04B 1/385 379/430 |

(Continued)

FOREIGN PATENT DOCUMENTS

| | | |
|---|---|---|
| EP | 1093098 A1 | 4/2001 |
| EP | 2833693 A1 | 2/2015 |
| WO | 2006/051113 A1 | 5/2006 |

*Primary Examiner* — Khai M Nguyen

(74) *Attorney, Agent, or Firm* — Gabriela B. Tomescu, Esq.; Bergenstrahle & Partners AB

(57) ABSTRACT

An antenna device for radio communications in a wearable device comprises a ground plate having an arc shape, a first antenna plate extending essentially parallel to the ground plate and connected thereto at a first end portion of the ground plate, the first antenna plate having a first feed terminal, and a second antenna plate extending essentially parallel to a the ground plate and connected thereto at a second end portion of the ground plate opposite to the first end portion of the ground plate, the second antenna plate having a second feed terminal. A gap is provided between the first antenna plate and the second antenna plate.

13 Claims, 4 Drawing Sheets

(56) References Cited

U.S. PATENT DOCUMENTS

| | | | | |
|---|---|---|---|---|
| 7,782,269 | B2 * | 8/2010 | Soler Castany | H01Q 1/242 343/700 MS |
| 7,808,433 | B2 * | 10/2010 | Rutfors | H01Q 1/243 343/700 MS |
| 8,077,110 | B2 * | 12/2011 | Soler Castany | H01Q 1/242 343/702 |
| 2003/0193437 | A1 | 10/2003 | Kangasvieri et al. | |
| 2004/0222930 | A1 * | 11/2004 | Sun | A44C 5/0007 343/718 |
| 2013/0241795 | A1 | 9/2013 | Sung et al. | |
| 2014/0049443 | A1 * | 2/2014 | Katz | H01Q 1/273 343/871 |
| 2014/0354494 | A1 * | 12/2014 | Katz | H01Q 1/273 343/718 |

* cited by examiner

ANTENNA DEVICE AND WEARABLE DEVICE COMPRISING SUCH ANTENNA DEVICE

This application claims priority to the Chinese Patent Application Number CN-201410318668.0, filed 2 Jul. 2014, and Chinese Patent Application Number CN-201420370875.6, filed 2 Jul. 2014, the entire content of which is hereby incorporated by reference.

BACKGROUND

The present invention relates generally to wireless communication devices and more particularly to an antenna device for radio communication in a wearable device, as well as a wearable device comprising such antenna device.

A "wearable device" is a device which can be worn by a user, such as glasses, gloves, and watches. With the development of technology, increasingly advanced wearable devices are produced, such a smart watches. The rapid development of the Internet also offers new possibilities for intelligent wearable devices.

The combination of improved radio communication technologies and the development of services through the Internet opens new opportunities for networked wearable devices. However, this relies on improved antenna devices suitable for implementation in wearable devices.

It is known that the characteristics of the antenna device are changed when being close to a human body, as is the case in wearable devices, as opposed to being in free space. The comparatively large interfering area close to the antenna device of a wearable device poses problems as to the performance of the antenna.

SUMMARY OF INVENTION

An object of the present invention is to provide an antenna device for radio communications in a wearable device which has improved performance as compared to prior art antenna devices.

According to the invention there is provided an antenna device for radio communications in a wearable device, comprising: a ground plate having an arc shape, a first antenna plate extending essentially parallel to the ground plate and connected thereto at a first end portion of the ground plate, the first antenna plate having a first feed terminal, and a second antenna plate extending essentially parallel to a the ground plate and connected thereto at a second end portion of the ground plate opposite to the first end portion of the ground plate, the second antenna plate having a second feed terminal, wherein a gap is provided between the first antenna plate and the second antenna plate. An antenna device for radio communications in a wearable device which has improved performance as compared to prior art antenna devices is thereby provided. This antenna device will provide a high frequency and a low frequency antenna function to meet Wifi, GPS and mobile communication signal transmission requirements.

In a preferred embodiment, the distance between the ground plate and the first and second antenna plates is less than 8 millimetres, and more preferably in the range of 1.5-5 millimetres. This provides for a compact device while retaining good antenna characteristics.

In a preferred embodiment, the gap is in the range of 1-5 millimetres.

In a preferred embodiment, at least one of the first and second antenna plates is provided with adjusting means electrically connected to the ground plate. Thereby, the characteristics of the antenna device can be easily and quickly adjusted to meet the needs of different wearable device applications.

In a preferred embodiment, the length of the first antenna plate is equal to ¼ of the antenna plate low frequency wavelength. Correspondingly, the length of the second antenna plate is in a preferred embodiment equal to ¼ of the antenna plate high frequency wavelength.

In a preferred embodiment, the radius of the ground plate is in the range of 10-50 millimetres, more preferably in the range of 20-40 millimetres, and most preferably in the range of 25-35 millimetres.

In a preferred embodiment, the width of the antenna device is 5-40 millimetres.

In a preferred embodiment, the first and second end portions of the ground plate are in a longitudinal direction of the antenna device. Alternatively, the first and second end portions of the ground plate are in a transverse direction of the antenna device.

In a preferred embodiment, the antenna device comprises a third antenna plate provided with a third feed terminal for feeding RF signals, wherein a gap is provided between on one side the first and second antenna plates and on the other side the third antenna plate.

According to the invention, there is also provided a wearable device comprising an apparatus main body and an antenna according to the invention. Thanks to the configuration, the impact on tissue of a wearer of the wearable device will be low, despite the small distance between the antenna device and the lossy tissue.

In a preferred embodiment, the apparatus main body is provided on the outer surface of one of the first and second antenna plates, and the apparatus main body does not cover the gap. Leaving the gap not covered gives better antenna performance as compared to covering the gap between the first and second antenna plates. Alternatively, the apparatus main body is provided in the gap (6) between the first antenna plate and the second antenna plate.

BRIEF DESCRIPTION OF DRAWINGS

The invention is now described, by way of example, with reference to the accompanying drawings, in which.

DESCRIPTION OF EMBODIMENTS

In the following, a detailed description of an antenna device for radio communications in a wearable device will be given. It will be appreciated that any directions given are as shown in the figures.

Figure 1:
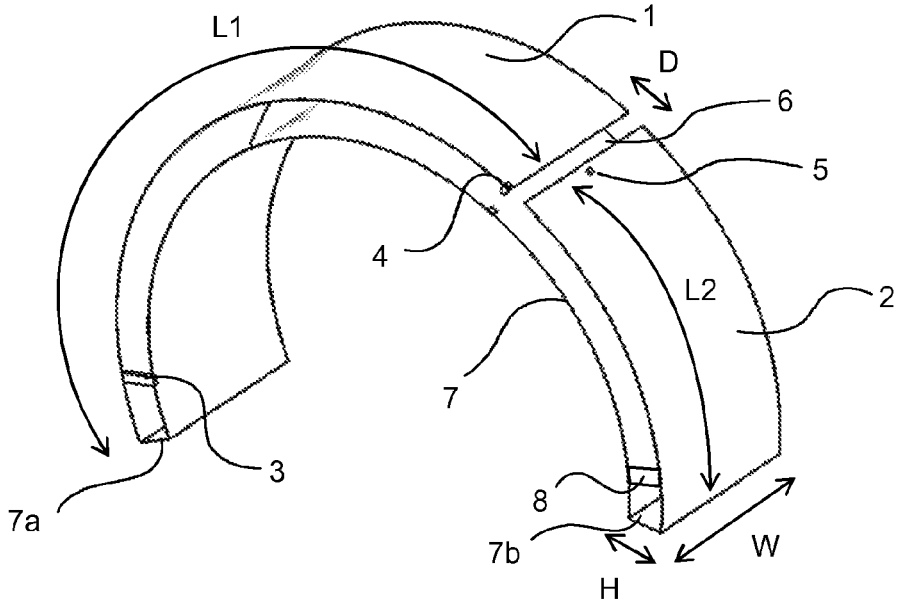
FIG. 1 is a schematic view of the structure of an antenna device according to a first embodiment of the invention.
Figure 2:
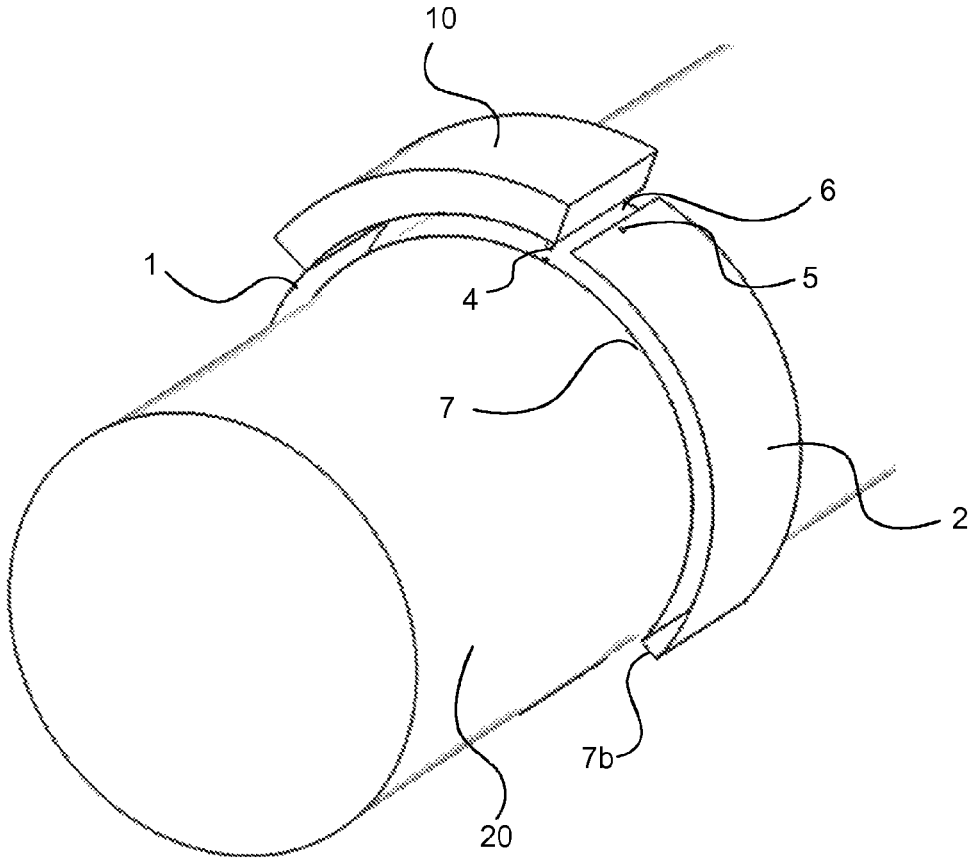
FIG. 2 shows the antenna device of FIG. 1 applied on a wearable device.

With reference to FIGS. 1 and 2, an antenna device for radio communications in a wearable device according to the invention comprises a ground plate 7 having an arc shape. The term "arc shape" should be interpreted as a curved part of an ellipse, such as a circle or near circle. The ground plate may or may not include an antenna substrate.

A first antenna plate 1 extends essentially parallel to the ground plate 7 and connected is thereto at a first end portion 7*a* of the ground plate. The first antenna plate 1 has a first feed terminal 4 for feeding of RF signals. The length of the first antenna plate 1 is preferably equal to ¼ of the antenna plate low frequency wavelength of the antenna device. The low frequency wavelength is often in the 700-960 MHz frequency range, usually applied to GSM communication band and GPS signals. The first antenna plate 1 is in the preferred embodiment provided with adjusting means 3 electrically connected to the ground plate 7. This adjusting means is used for fine tuning the first antenna plate to desired frequencies.

A second antenna plate 2 extends essentially parallel to the ground plate and connected thereto at a second end portion 7*b* of the ground plate opposite to the first end portion 7*a* of the ground plate. In this embodiment, the first and second end portions 7*a*, 7*b* of the ground plate are in the longitudinal direction of the antenna device. The second antenna plate has a second feed terminal 5 for feeding of RF signals. The length of the second antenna plate 2 is preferably equal to ¼ of the antenna plate high frequency wavelength of the antenna device. The high frequency wavelength is often in the 1800-2300 MHz frequency range, usually applied to high frequency mobile communications and wireless network (WIFI) signals. Also the second antenna plate 2 is in the preferred embodiment provided with adjusting means 8 electrically connected to the ground plate 7.

The fact that the first and second antenna plates 1, 2 extend essentially parallel to the ground plate 7 means that also the first and second antenna plates are arc shaped, each covering part of the circle sector covered by the ground plate.

The distance between the ground plate and the first and second antenna plates 1, 2, denoted H in FIG. 1, is preferably less than 8 millimetres and more preferably in the range of 1.5-5 millimetres. The width of the antenna device, denoted W in FIG. 1, is preferably in the range of 5-40 millimetres. In other words, the width of the first and second antenna plates 1, 2 as well as the ground plate 7 is in this range.

A gap 6 is provided between the first antenna plate 1 and the second antenna plate 2. This gap 6 is preferably in the range of 1-5 millimetres. The first and second feed terminals 4, 5 can be placed practically anywhere between the ground and the first and second antenna plate, respectively, preferably going the shortest way from antenna plate to the ground plate. However, in the preferred embodiment described with reference to the figures the feed terminals 4, 5 are provided close to the gap 6.

A wearable device comprising an antenna device as described above is shown in FIG. 2. The wearable device also comprises an apparatus main body 10, which could be a watch or similar device. The apparatus main body 10 is provided on the outer surface of one of the first and second antenna plates 1, 2 so that the apparatus main body 10 does not cover the gap 6.

The radius of the ground plate is preferably adapted so that the wearable device can be fitted around the wrist of a wearer, shown as part 20 in FIG. 2. Thus, in a preferred embodiment the radius of the ground plate 7 is in the range of 10-50 millimetres, more preferably in the range of 20-40 millimetres, and most preferably in the range of 25-35 millimetres,.

Figure 3:
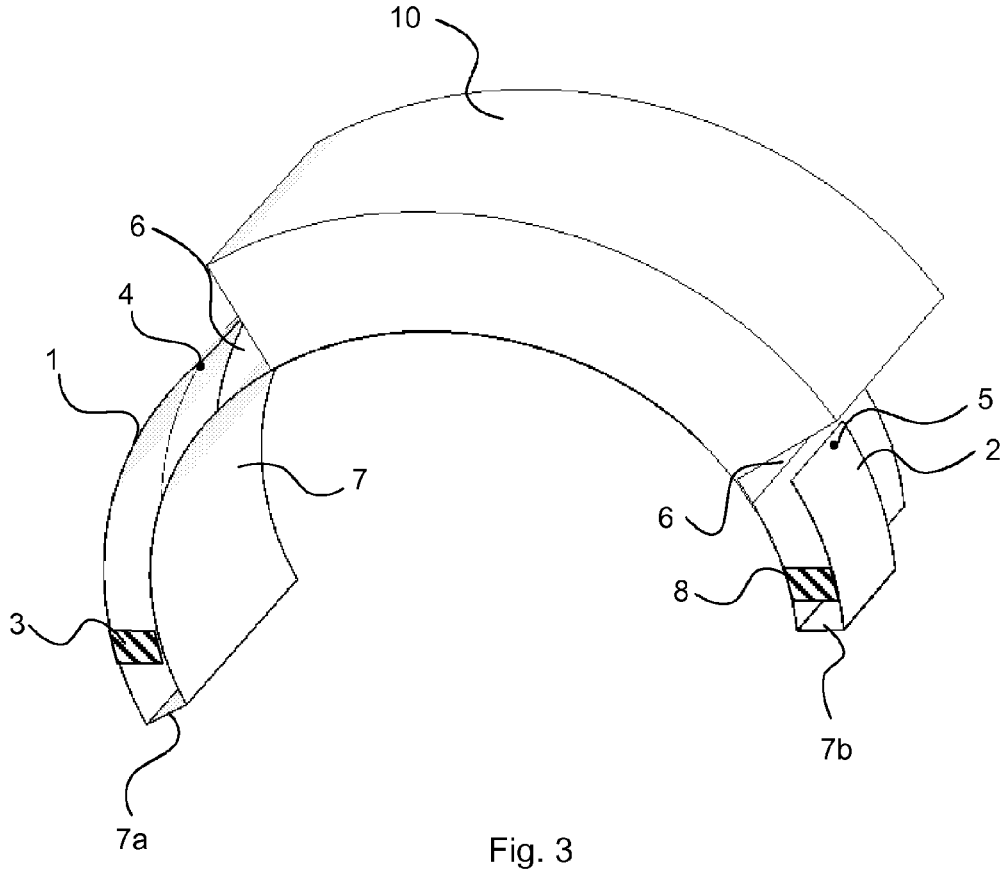
FIG. 3. is a schematic view of the structure of an antenna device according to a second embodiment of the invention.
Figure 4:
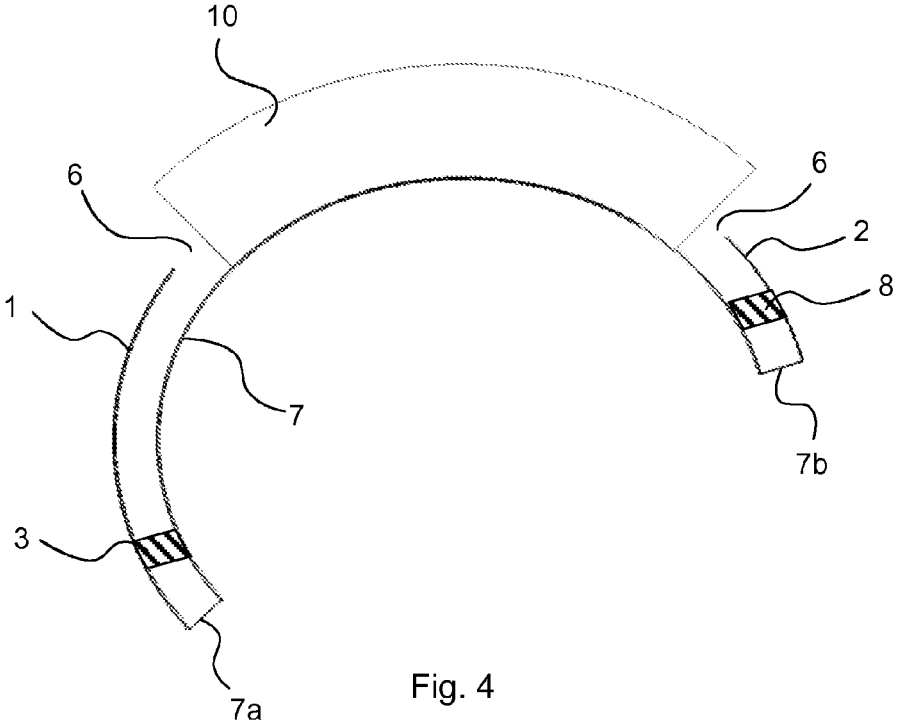
FIG. 4 is a side view of the antenna device shown in FIG. 3.

In an alternative embodiment, shown in FIGS. 3 and 4, the apparatus main body 10 is provided in the gap 6 between the first antenna plate 1 and the second antenna plate 2. This body can take any suitable size, but is preferably between $30\times30\times2.5$ mm$^3$ and $58\times58\times12$ mm$^3$, and in the shown embodiment the apparatus main body rests on the ground plate 7. This means that the gap 6 between the first and second antenna plates 1, 2 is partly abridged by the apparatus main body 10.

As in the first embodiment, a first feed terminal 4 for the first antenna plate 1 and a second feed terminal 5 for the second antenna plate 2 are provided. Although they can be placed anyway on the respective antenna plate, it is preferred to provide them close to the gap 6. Like in the first embodiment, there is also a first adjustment means 3 between the ground plate 7 and the first antenna plate 1 and also a second adjustment means 8 between the ground plate 7 and the second antenna plate 2. These adjusting means are used for fine tuning the first antenna plate to desired frequencies.

The length of the first antenna plate 1 is preferably equal to ¼ of the antenna plate low frequency wavelength of the antenna device. The low frequency wavelength is often in the 700-960 MHz frequency range, usually applied to GSM communication band and GPS signals. The length of the second antenna plate 2 is preferably equal to ¼ of the antenna plate high frequency wavelength of the antenna device. The high frequency wavelength is often in the 1800-2300 MHz frequency range, usually applied to high frequency mobile communications and wireless network (WIFI) signals.

The width of the antenna plates can be adapted for different needs. Thus, from FIG. 3 it is seen that the width of the second antenna plate 2 is less than the width of the first antenna plate 1 and of the apparatus main body 10 and the width of the apparatus main body 10 can be up to 60 millimetres or even more. This opens up for other uses of the space beside the second antenna plate 2.

The width of the gap between the respective antenna plate 1, 2 and the apparatus main body 10 is preferably between 1 and 5 millimetres. The gap between the first and second antenna plates should preferably be larger than 0.1 millimetres.

In all other aspects, this second embodiment corresponds to the first embodiment described above with reference to FIGS. 1 and 2.

Figure 5:
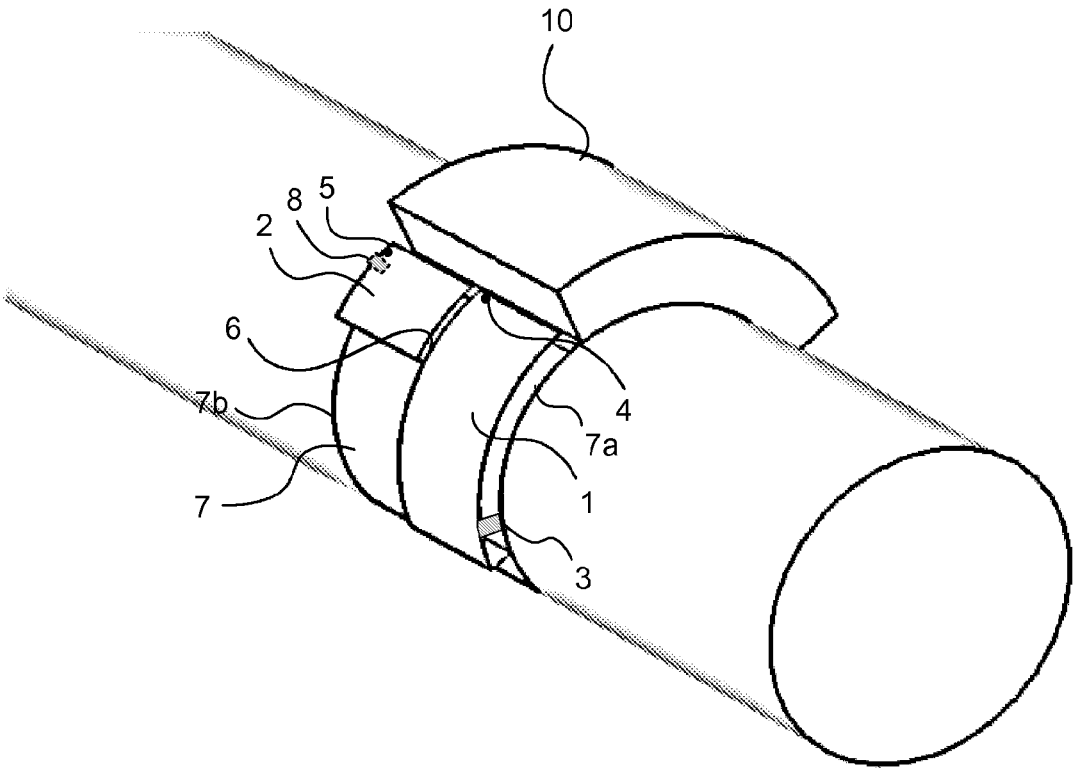
FIG. 5 is a schematic view of the structure of an antenna device according to a third embodiment of the invention.

Instead of providing the gap between the two antenna elements in the circumferential direction of the antenna device, as in the embodiments described above, it can also be provided between the two antenna elements in the transversal direction of the antenna device. This configuration is shown in FIG. 5. A first antenna plate 1 extends essentially parallel to the ground plate 7 and connected thereto along an end of the first antenna plate 1. The first antenna plate 1 has a first feed terminal 4 for feeding of RF signals. The length of the first antenna plate 1 is preferably equal to ¼ of the antenna plate low frequency wavelength of the antenna device. The low frequency wavelength is often in the 700-960 MHz frequency range, usually applied to GSM communication band and GPS signals. The first antenna plate 1 is in the preferred embodiment provided with adjusting means 3 electrically connected to the ground plate 7 at a first end portion 7*a* of the ground plate. This adjusting means is used for fine tuning the first antenna plate to desired frequencies.

A second antenna plate 2 extends essentially parallel to the ground plate and connected thereto along an end of the second antenna plate 2. The second antenna plate has a second feed terminal 5 for feeding of RF signals. The length of the second antenna plate 2 is preferably equal to ¼ of the antenna plate high frequency wavelength of the antenna device. The high frequency wavelength is often in the 1800-2300 MHz frequency range, usually applied to high frequency mobile communications and wireless network (WIFI) signals. The second antenna plate 2 is in this embodiment provided with adjusting means 8 electrically connected to the ground plate 7 at a second end portion 7*b* of the ground plate opposite to the first end portion 7*a* of the ground plate. As can be seen, in this embodiment the first and second end portions 7*a*, 7*b* of the ground plate are in the transverse direction.

In all other aspects, this third embodiment corresponds to the first embodiment described above with reference to FIGS. 1 and 2.

Figure 6:
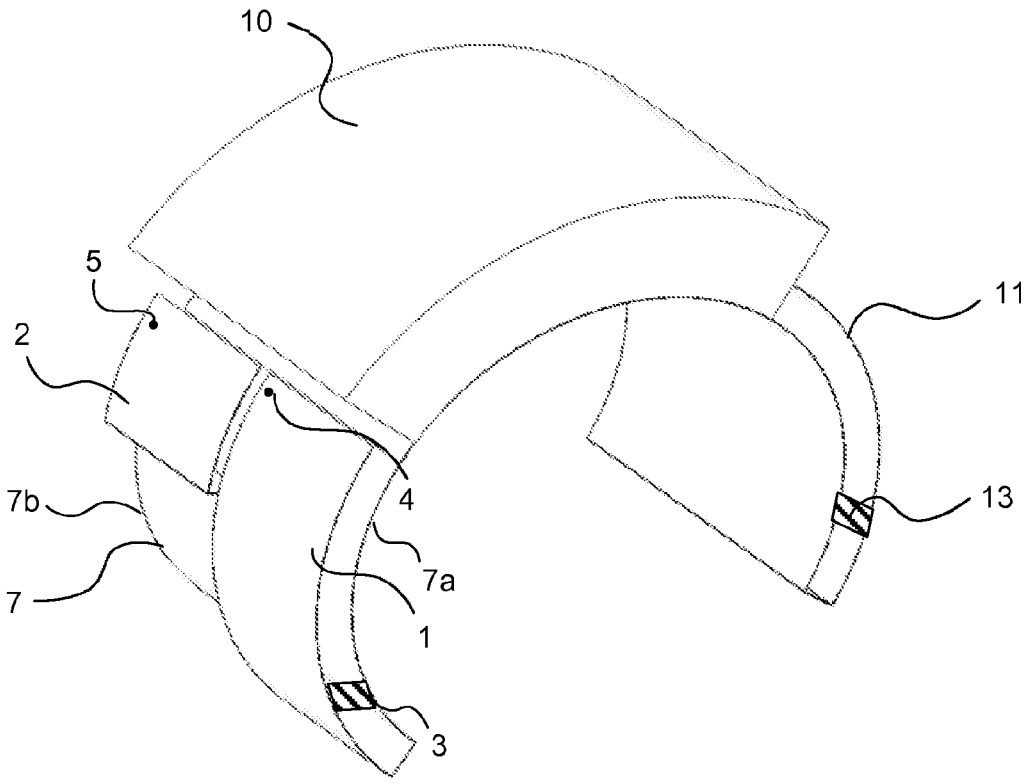
FIG. 6 is a schematic view of the structure of an antenna device according to a fourth embodiment of the invention.
Figure 7:
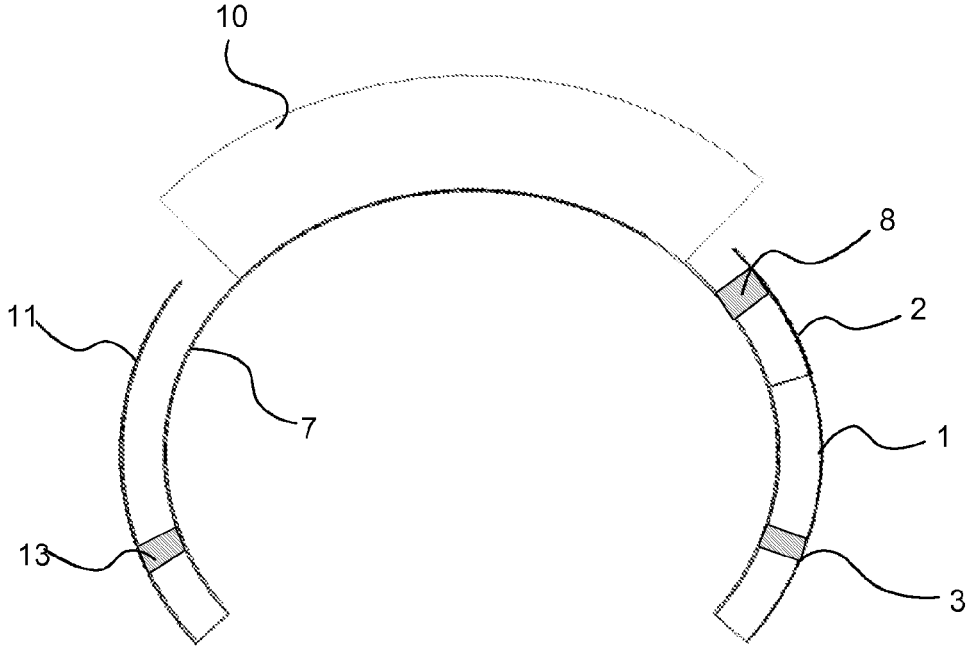
FIG. 7 is a side view of the antenna device shown in FIG. 6.

The second and third embodiments of FIGS. 3 and 4 and FIG. 5, respectively, can be combined into an antenna device comprising three antenna plates, as shown in FIGS. 6 and 7. Thus, besides the first and second antenna elements 1, 2, as in the embodiment of FIG. 5, there is a third antenna plate 11 provided with a third feed terminal 12 for feeding RF signals. The apparatus main body 10 is provided in a gap between on one side the first and second antenna plates 1, 2 and on the other side the third antenna plate 11. The length of the third antenna plate 11 is preferably equal to ¼ of the antenna plate third frequency wavelength of the antenna device. This third frequency wavelength is often in the 1570-2500 MHz frequency range, usually applied to WiFi communication and GPS signals. The third antenna plate 11 is in the preferred embodiment provided with adjusting means 13 electrically connected to the ground plate 7 at an edge portion of the ground plate. This adjusting means is used for fine tuning the first antenna plate to desired frequencies.

In all other aspects, this fourth embodiment corresponds to the first embodiment described above with reference to FIGS. 1 and 2.

Preferred embodiments of an antenna device and a wearable device comprising such an antenna device have been described. It will be realized that these can be varied within the scope of the appended claims.

The invention claimed is:

1. An antenna device for radio communications in a wearable device, comprising:

a ground plate having an arc shape, a first antenna plate extending essentially parallel to the ground plate and connected thereto at a first end portion of the ground plate, the first antenna plate having a first feed terminal, and a second antenna plate extending essentially parallel to the ground plate and connected thereto at a second end portion of the ground plate opposite to the first end portion of the ground plate, the second antenna plate having a second feed terminal, wherein a gap is provided between the first antenna plate and the second antenna plate, wherein the first and second antenna plates are arc shaped, each covering different parts of the circle sector covered by the ground plate, on a same side of the ground plate.

2. The antenna device according to claim 1, wherein the distance between the ground plate and the first and second antenna plates is less than 8 millimetres.

3. The antenna device according to claim 2, wherein the distance between the ground plate and the first and second antenna plates is in the range of 1.5-5 millimetres.

4. The antenna device according to claim 1, wherein the gap is in the range of 1-5 millimetres.

5. The antenna device according to claim 1, wherein at least one of the first and second antenna plates is provided with adjusting means electrically connected to the ground plate.

6. The antenna device according to claim 1, wherein the radius of the ground plate is in the range of 10-50 millimetres.

7. The antenna device according to claim 1, wherein the width of the antenna device is 5-40 millimetres.

8. The antenna device according to claim 1, wherein the first and second end portions of the ground plate are in a longitudinal direction of the antenna device.

9. The antenna device according to claim 1, wherein the first and second end portions of the ground plate are in a transverse direction of the antenna device.

10. The antenna device according to claim 1, comprising a third antenna plate provided with a third feed terminal for feeding RF signals, wherein a gap is provided between on one side the first and second antenna plates and on the other side the third antenna plate.

11. A wearable device comprising an apparatus main body and an antenna according to claim 1.

12. The wearable device according to claim 11, wherein the apparatus main body is provided on the outer surface of one of the first and second antenna plates, and the apparatus main body does not cover the gap.

13. The wearable device according to claim 11, wherein the apparatus main body is provided in the gap between the first antenna plate and the second antenna plate.

* * * * *